US007409837B2

(12) United States Patent
Smith

(10) Patent No.: US 7,409,837 B2
(45) Date of Patent: Aug. 12, 2008

(54) INTERCHANGEABLE JEWELLERY INSERT AND ITEM FOR RECEIVING THE INSERT

(76) Inventor: Robert D. Smith, 27 Diana Grace Avenue, Dartmouth, Nova Scotia (CA) B2W BA2

( * ) Notice: Subject to any disclaimer, the term of this patent is extended or adjusted under 35 U.S.C. 154(b) by 164 days.

(21) Appl. No.: 11/212,607

(22) Filed: Aug. 29, 2005

(65) Prior Publication Data

US 2007/0044512 A1 Mar. 1, 2007

(30) Foreign Application Priority Data

Aug. 26, 2005 (CA) ..... 2517280

(51) Int. Cl.
*A44C 17/02* (2006.01)

(52) U.S. Cl. ..... 63/40; 63/29.1; 63/30

(58) Field of Classification Search ..... None
See application file for complete search history.

(56) References Cited

U.S. PATENT DOCUMENTS

| | | | | |
|---|---|---|---|---|
| 2,600,319 | A | 6/1952 | Postel | |
| 4,220,018 | A | 9/1980 | Chuard | |
| 4,374,470 | A | 2/1983 | Isaacson | |
| 4,800,738 | A * | 1/1989 | Bunz | 63/26 |
| 4,899,556 | A | 2/1990 | Ford | |
| 5,315,739 | A | 5/1994 | Herman | |
| 5,414,948 | A | 5/1995 | Kudo | |
| 6,026,658 | A | 2/2000 | Weller | |
| 6,427,487 | B1 | 8/2002 | Morgan | |
| 6,470,709 | B1 | 10/2002 | Siekierski | |
| 6,491,424 | B1 * | 12/2002 | Tardy | 368/283 |
| 6,588,067 | B2 | 7/2003 | Efron et al. | |
| 6,742,359 | B1 | 6/2004 | Takessian | |

FOREIGN PATENT DOCUMENTS

| | | | |
|---|---|---|---|
| FR | 2667488 | A1 | 4/1992 |

* cited by examiner

*Primary Examiner*—Jack W. Lavinder
(74) *Attorney, Agent, or Firm*—Xiang Lu; Gowling Lafleur Henderson LLP

(57) ABSTRACT

An interchangeable jewelry insert having an extension formed of elastic material that can frictionally engage a surface of a receptacle for receiving the insert. The interchangeable jewelry insert may be detachably attached to any item that can be configured to have a receptacle for receiving the insert. The extension of the interchangeable jewelry insert is sized for convenience of handling and storage. The use of an elastically deformable extension extending, at two or more points having sufficient angular separation, from the periphery of the body of an insert allows for a secure fit within the receptacle, while maintaining a convenient connection system that can be manipulated by manual forces of a jewelry wearer.

13 Claims, 16 Drawing Sheets

2
4
6
8
10
12
14
16
18
20

22
24
26
28
30
32
A
B
C
D
E
F
G
H
I
J
K
L
M
N
O
P
Q
R
S
T
U
V
W
X
Y
Z
A 9.75 mm
B 14.23 mm
C 14.96 mm
D 15.46 mm
E 26.06 mm
C 1.44 mm
D 4.2 mm
1.4 mm
K 7.5 mm
L 1.5 mm 36
36
34

34

36

36

66
64
68
4.80
View AA
Grommet side view
62
60
58
62
R 7.0mm
3.3mm
R 2.8mm
A
A
Grommet top view
68

Top View Rubber Sleeve

Cut Away View Rubber Sleeve

Side view Rubber Sleeve

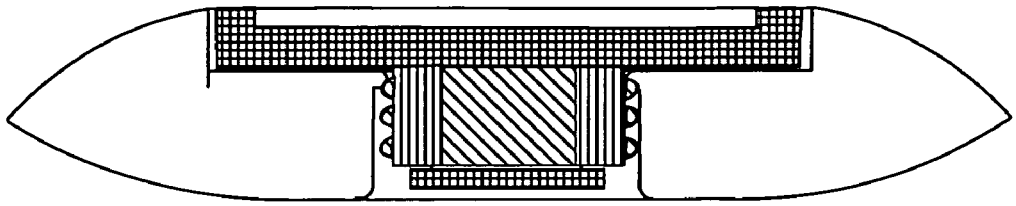
Fig. 12G
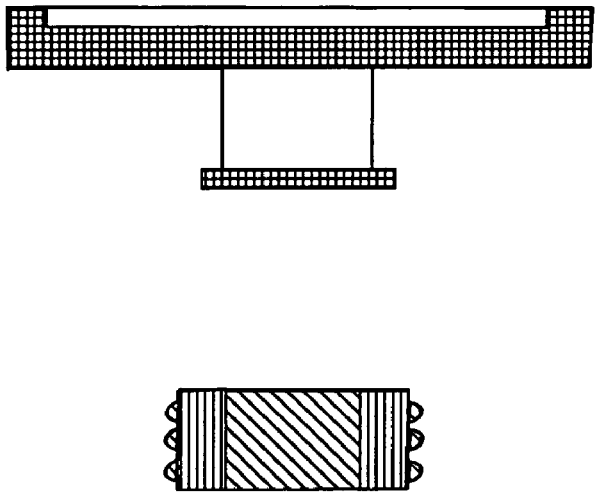
Fig. 12F
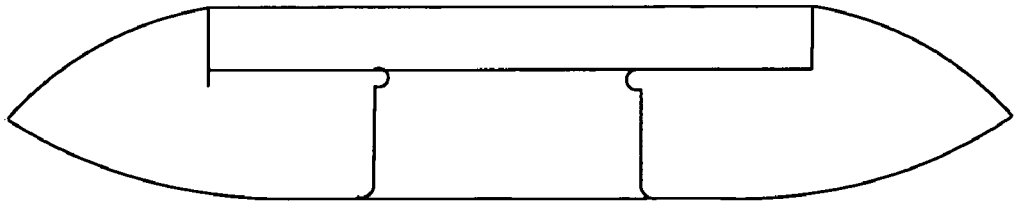

INTERCHANGEABLE JEWELLERY INSERT AND ITEM FOR RECEIVING THE INSERT

REFERENCE TO RELATED APPLICATION

This application claims benefit of Canadian Application Ser. No. 2,517,280, entitled "Interchangeable Jewelry Insert and Item for Receiving the Insert", filed on Aug. 26, 2005, the disclosure of which is incorporated herein by reference.

FIELD OF INVENTION

The present invention relates to the field of jewelry. More particularly, the present invention relates to interchangeable jewelry inserts, items for receiving the insert, and connectors for reversibly securing the interchangeable insert within the items.

BACKGROUND OF THE INVENTION

Jewelry has been with humanity since the beginning as people have always felt the need to adorn themselves for a variety of reasons including a sense of individuality, beauty and simply as a means of attracting attention. Jewelry is a multi billion dollar worldwide business.

The ability to interchange, personalize and accessorize has always been a facet of the jewelry industry. It is an innate human desire to transform an item from an object one has purchased to an object that resonates with the owners personality, clothing or current moods. In modern times many different people have brought forward ideas to aid people in accomplishing this. Some of the recent ideas that are in the current market place are Italian Charm Link Bracelets and interchangeable bead bracelets. However, these items are complicated for the wearer to modify. The Italian Charm Link Bracelet, in particular, typically requires the use of a tool to force openings in the bracelet to insert or extract an interchangeable charm.

U.S. Pat. No. 6,427,487 (Morgan), U.S. Pat. No. 5,414,948 (Kudo), U.S. Pat. No. 6,588,067 (Efron), U.S. Pat. No. 6,026,658 (Weller), U.S. Pat. No. 4,374,470 (Isaacson), and U.S. Pat. No. 6,742,359 (Takessian) all disclose jewelry items with interchangeable inserts. Each of these jewelry items requires manipulation of moving or moveable parts in order to change and secure an insert. As such the act of insertion is time consuming for the jewelry wearer. Furthermore, moving parts are susceptible to break down.

Accordingly, there is a need for an interchangeable jewelry insert that can be conveniently attached to or detached from a jewelry item.

SUMMARY OF THE INVENTION

The present invention relates to the field of jewelry. More particularly, the present invention relates to interchangeable jewelry inserts, items for receiving the insert, and connectors for reversibly securing the interchangeable insert within the items.

It is an object of the invention to provide an improved interchangeable jewelry insert or item for receiving the insert, and a convenient system of detachably attaching the insert to the item.

According to the present invention there is provided an interchangeable jewelry insert for detachable attachment to a receptacle of an item, the insert comprising:

a body having at least one dimension that is sized to fit within the receptacle of the item; and an extension, for engaging a surface of the receptacle, formed of elastic material coupled to the body and extending outward from two or more points on the periphery of the body, each extension distance being less than 0.33 times the largest dimension of the body, the two or more points on the periphery having at least one angular separation of greater than 30 degrees.

In certain aspects of the present invention, the extension of the interchangeable insert is a closed continuous circuit along the periphery of the body. In certain other aspects, the extension may be continuous along a portion of the periphery of the body, the portion having end points with an angular separation of greater than 45 degrees.

In certain aspects of the invention, the two or more points on the periphery of the body of the interchangeable insert having extensions extending therefrom are separate and opposing portions on the periphery of the body. In certain other aspects, the two or more points have an angular separation of greater than 45 degrees. In still other aspects, the two or more points have an angular separation of at least 90 degrees.

In certain aspects of the present invention, the extension distance of the elastic extension of the interchangeable insert is less than 0.3 times the largest dimension of the body. In certain other aspects, the extension distance is less than 0.2 times the largest dimension of the body.

According to the present invention there is provided a receptacle for receiving an interchangeable jewelry insert. The receptacle may be incorporated into any item or any item may be configured or manufactured to comprise a receptacle. In a particular aspect of the invention there is provided a jewelry item receptacle for receiving an interchangeable jewelry insert, the receptacle comprising:

a base and a sidewall, the base having two opposing points sized to fit at least one dimension of a body of the interchangeable jewelry insert, the sidewall having an inward extension extending towards a central axis of the receptacle, the inward extension of the receptacle sized for deforming an elastically deformable extension that extends outward from the body of the interchangeable jewelry insert; and the receptacle having a surface for frictionally engaging the elastically deformable extension.

In certain aspects of the present invention, an inward extension of the receptacle is for engaging an elastic extension of an interchangeable insert on a surface of the inward extension that is closest to the base of the receptacle. The inward extension may comprise a continuous closed extension or may be comprised of discrete separate components. In certain other aspects, the elastic extension is to be engaged on a surface of the sidewall of the receptacle. In particular examples, the surface may be a cavity or groove in the sidewall. In another example, the surface for engaging the elastic extension is in between an inward extension and the base of the receptacle.

In certain aspects of the present invention, a sidewall rises from the base of a receptacle to form a continuous and closed sidewall. In certain other aspects of the invention, an inward extension is continuous along the entire interior surface of the sidewall or an inward extension may comprise separate and discrete components.

According to the present invention there is provided a jewelry grommet receptacle for receiving an interchangeable jewelry insert, the receptacle comprising:

a continuous sidewall defining the interior of the receptacle, the sidewall having two open ends, a lid end and a base end, the lid end having a lid flange extending radially outward and an inward extension extending towards a central axis of the receptacle, the inward extension sized for deforming an elastically deformable extension that extends outward from a body of the interchangeable jewelry insert; and the receptacle having a surface for frictionally engaging the elastically deformable extension.

This summary of the invention does not necessarily describe all features of the invention.

BRIEF DESCRIPTION OF THE DRAWINGS

These and other features of the invention will become more apparent from the following description in which reference is made to the appended drawings wherein:

FIG. 1 shows top and side views of a ring in accordance with an embodiment of the present invention.

FIGS. 12A-G show another example of the invention, with FIGS. 12A and 12B showing top and side views of a body of an interchangeable insert, FIGS. 12C, 12D, and 12E show a top view, side cross-section view, and side view of the rubber sleeve, FIGS. 12F and 12G showing exploded and assembled views of the pendant and insert combination in accordance with a further embodiment of the present invention;

DETAILED DESCRIPTION

Figures 1A, 1B, 1C, 1D:
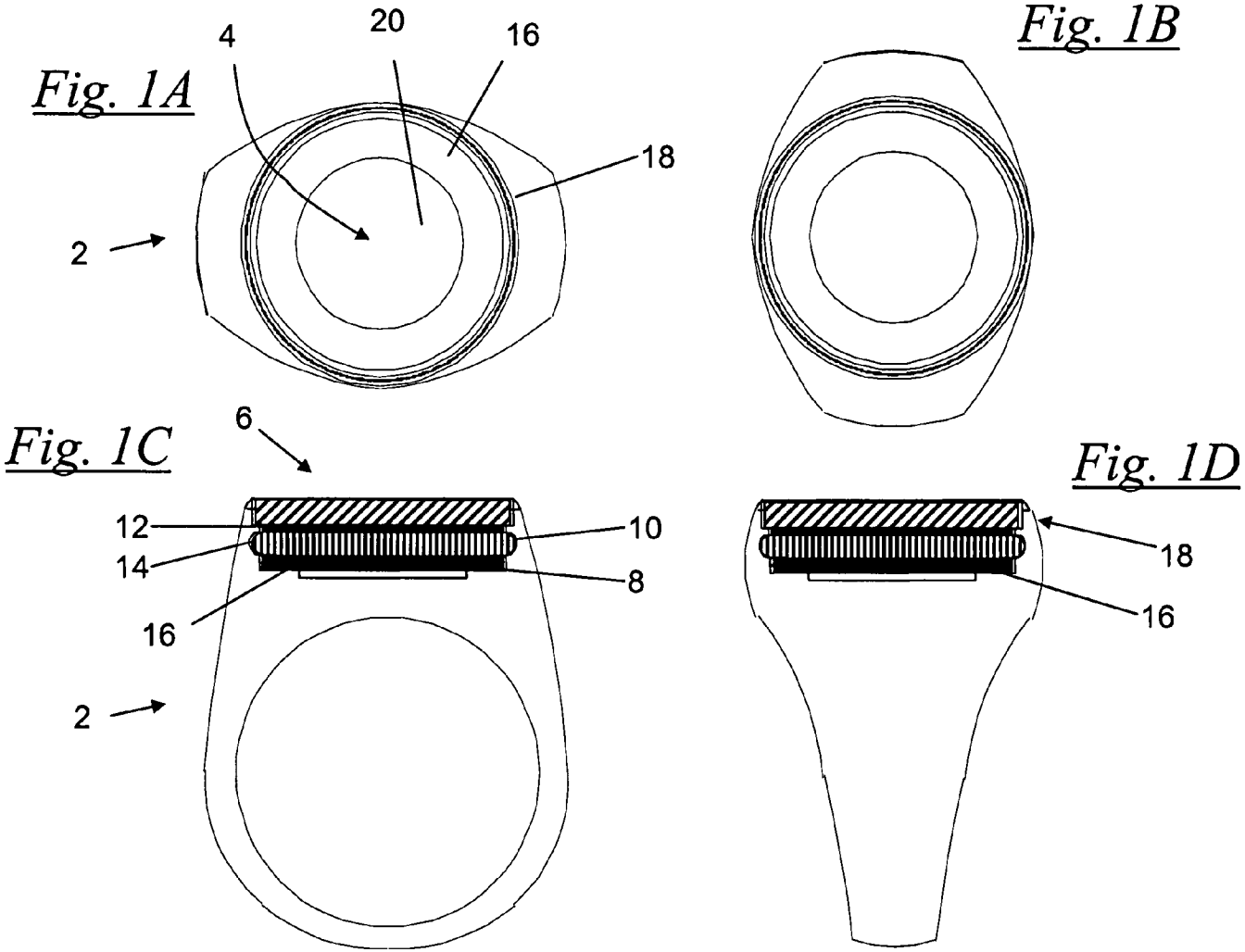
FIGS. 1A and 1B show top views of a ring with an empty receptacle.
FIGS. 1C and 1D show side views of a ring with an interchangeable insert attached therein.

The following description is of a preferred embodiment.

The type of item for receiving an interchangeable jewelry insert is not critical to the present invention. Jewelry types that can be worn on the body or through parts of the body are contemplated. Jewelry types that can be incorporated into clothing or other articles are also contemplated. Furthermore, items may be common objects such as bags, shoes, pens, key chains, or zipper pulls, that have been configured to receive a jewelry insert and are thereby transformed into a jewelry item. In certain examples, interchangeable inserts may be interchangeable amongst all jewelry types including, rings, earrings, pendants, bracelets, necklaces, pins and brooches and body piercing jewelry. In other examples, interchangeable inserts may fit in grommets, pens, zipper pulls, watch straps, shoes, bags, belts, handbags, hats, backpacks, clothing, key chains, leather wristbands, and pet jewelry. As will be recognized by persons skilled in the art, an item surface may be manufactured to have a receptacle for receiving an interchangeable jewelry insert. Interchangeable inserts and their receptacles may be standardized such that a single interchangeable insert can fit into a variety of items, or that a single item can be fitted with a variety of inserts.

In examples of the present invention a jewelry item has a receptacle or chamber for receiving an interchangeable insert. The receptacle comprises a base having two opposing points sized to fit at least one dimension of a body of an interchangeable insert. The base may be a closed surface or have an opening. The body of the interchangeable insert will have at least one dimension sized to fit within the receptacle of a jewelry item. Having at least one dimension of the body of the insert sized to fit within opposing points on the base of the receptacle helps to achieve a secure fit when an extension formed of elastic material extends from the body and engages a base of the receptacle, a sidewall of the receptacle, or both the base and the sidewall. In one simplified example the receptacle is a flat base having an opening and the interchangeable insert body has a first portion that is sized to freely pass through the opening and a second portion that cannot pass through the opening with an elastic extension, that is to be deformed by the opening, extending from between the two portions; the insert is pushed through the opening so that the first portion of the body and the elastic extension pass through while the second portion does not. In one example, the receptacle and body are cylindrical and the diameter of the body is sized to fit within the receptacle. In another example, the receptacle and body are rectangular prisms and the smallest dimension of the base of the body is sized to fit within opposing points on the base and opposing sidewalls of the receptacle.

In particular examples of the present invention, a jewelry item receptacle will typically have a base and a sidewall. The base may be closed or may have an opening such that a finger, pen or other rod like element may be inserted through the opening to push out an interchangeable insert that has been inserted within the receptacle. In examples where an interchangeable insert is pushed into a receptacle and pushed out of the receptacle a convenient opening in the base of the receptacle is useful. However, in examples where an interchangeable insert is pushed into a receptacle and pulled out of the receptacle an opening in the base of the receptacle is not necessary. An opening in the base may be of various sizes, but will typically be equal to or less than a perimeter defined by a sidewall. A jewelry item receptacle will preferably have a sidewall rising from the base. The sidewall may be continuous or may be separated by spaces. For example, a jewelry item designed to accept a cubic interchangeable insert may have a continuous sidewall rising from a quadrilateral base, such that the sidewall has four distinct faces that can encompass at least two dimensions of a cubic insert. In a related example, the receptacle may have a sidewall rising from three sides of a quadrilateral base such that the sidewall has three distinct faces that can encompass at least one dimension of a cubic insert between opposing faces of the sidewall. In another related example, the receptacle may have a sidewall rising from two opposing sides of a quadrilateral base such that the sidewall has two opposing, distinct and separated faces that can encompass at least one dimension of a cubic insert.

Another example of a jewelry item receptacle is a grommet. A grommet receptacle will typically have a continuous sidewall defining the interior of the receptacle, with the sidewall having two open ends, a lid end and a base end. At the lid end there can be a lid flange extending radially outward. In particular examples, at the lid end there can be an inward extension extending towards a central axis of the receptacle, with the inward extension sized for deforming an elastic extension that extends outward from a body of an interchangeable jewelry insert. In certain other examples, the inward extension may run along the entire interior surface of the sidewall to form a continuous and closed extension. In other examples, the inward extension may be comprised of separate and discrete components such as dimples or stud-like projections. In still other examples, there may be no inward extension. In still further examples, there may be a cavity, channel, or groove in the sidewall at the lid end for frictionally engaging an elastic extension of an interchangeable insert. As will be recognized by persons skilled in the art, the grommet is incorporated into an item and kept in place due to opposing forces exerted by the lid flange and a retaining washer. The retaining washer is passed over the base end and along the exterior of the sidewall, and secured in place by extending the sidewall, at the base end, radially outward to form a base flange for engaging the retaining washer.

The body of the interchangeable insert may be made of any suitable material. In certain examples, a body having a metal housing that is identical to the metal of the jewelry item may be used; the metal housing having at least one dimension sized to fit within a receptacle, and further the metal housing may incorporate decorative elements. In other examples the body may be devoid of metal and may be made entirely of stone, such as a gem, with the stone being cut to be coupled with an elastically deformable material and to fit within a receptacle of a jewelry item. The body may be of any material known to a jewelry manufacturer including, without limitation, metal, stone, enamel, glass, plastic, ceramic, leather, rubber or combinations thereof.

The body of an interchangeable insert may be any shape provided that it has at least one dimension that is sized to fit within opposing points of a base of a jewelry item receptacle or within opposing points of a sidewall in examples where such opposing sidewalls are provided. For example, the body shape may be spherical, pyramidal, cubic, tubular, cylindrical, toroid, spiral, tetrahedral, polyhedral, helical, ziggurat, inverted ziggurat, conical, prismatic or any combination thereof.

The body of the interchangeable insert is coupled to an elastic material. The type of elastic material is not critical to the invention. The material should be sufficiently deformable by manual forces that can be exerted by a jewelry wearer, such that an interchangeable insert can be detachably attached to a jewelry item receptacle. Furthermore, the elastic material should be durable enough to withstand repeated attachment and detachment of an interchangeable insert. Non-limiting examples of suitable elastically deformable materials are natural rubber or other elastomers such as viton, nitrile, EPDM (ethylene propylene dimonomer), neoprene, polyurethane, or silicone. Plastics or metals having elastic properties or configured to be elastically deformable, for example as a spring, are other non-limiting examples of materials that can be used to form extensions. The elastic material may be in the form of ribs, studs, O-ring, C-ring, or any other form or configuration that provides for extension of elastic material from the body of an insert. The elastic material may originally be in molten or liquid form, and be poured, injected or molded into a suitable configuration. The coupling of the elastic material to the body of the insert may be accomplished in any convenient manner known in the art. For example, a rod of elastic material could pass through the body such that elastic material extends from two opposing points from the periphery of the body. In another example, a portion of the body may be placed in an elastic sleeve that has elastically deformable extensions extending therefrom. In still another example, a shaft of a cylindrical body may be fitted with an O-ring. In yet another example, a cubic body may be designed with slots for coupling to elastically deformable studs that would extend from several points along the periphery of the body. In yet a further example, an insert body is attached to a base made of elastic or non-elastic material that has an elastically deformable extensions extending therefrom. Still many further examples, can be configured by a person of skill in the art.

A jewelry item receptacle will have a surface that deforms an elastic extension of an interchangeable insert, with deforming of the elastic extension typically occurring due to shearing, compressing or both shearing and compressing forces. One example of such a surface is an inward extension or lip extending from a sidewall towards a central axis of the receptacle. The inward extension can extend at any angle from an interior surface of a receptacle provided that it extends a sufficient distance to engage and deform an elastic extension of an interchangeable insert. For example, an inward extension may extend at an angle of 20, 30, 40, 50, 60, 70, 80, 90 degrees or any angle therebetween with respect to the interior surface of the receptacle. In certain examples, the inward extension or lip may be substantially parallel to the base of the receptacle. In another example, a groove, channel or cavity that is for receiving and frictionally engaging an elastic extension may be made in an interior surface of the receptacle. In one example, a cavity is made with an opening that has at least one of it's dimensions sized smaller than a dimension of the elastic extension of the insert so as to deform an elastic extension that is pushed through the opening. The interior of the cavity may be larger than the opening to allow the portion of the elastic extension that has pushed through the cavity opening to at least partially regain its form. In another example the sidewall alone without any inward extension is sized to deform an elastic extension and a groove or a channel in the sidewall provides a surface for the elastic extension to at least partially regain its form and achieve a secure fit.

An extension formed of elastic material may extend at any angle from the surface or tangential surface of the body of an interchangeable insert, for example, an extension may extend at an angle of 20, 30, 40, 50, 60, 70, 80, 90 degrees or any angle therebetween with respect to the surface of the body. In certain examples, the angle will be from about 45 degrees to about 90 degrees relative to the surface of the body.

An extension formed of elastic material should not extend too long from the periphery of the body of an interchangeable insert. An extension that is too long is likely to get accidentally snagged when not in use and may get lost or broken. For example, earrings with a long projection that extends through the ear lobe must typically be stored in a special case to avoid getting accidentally hooked on material when not in use or being damaged by accidentally placing objects on the projections. U.S. Pat. No. 6,470,709 shows another example of an extension that is susceptible to loss or being damaged due to its length.

The present inventors have discovered that extension distance is an important parameter to consider in order to achieve production of an interchangeable insert that can be easily stored without the need for any protective casing. By "extension distance" is meant the shortest normal vector distance from a point on the periphery of the body to the outer edge of the elastic material. Extension distance may be proportional to the body of the interchangeable insert. As such extension distance can be larger, in absolute terms, with a larger body, and smaller with a smaller body. Typically, an extension distance of greater than 1 times the largest dimension of the body of an interchangeable insert is not preferred as the extension dominates the body and becomes unwieldy in terms of storage. An extension distance of less than 0.5 times or 0.4 times the largest dimension of the body is more convenient for storage purposes. An extension distance of less than 0.33 (or about one-third) times the largest dimension of the body is suitable for storage purposes as the extension is then protected in the shadow of the body and any material that may accidentally sweep across or be dropped on an interchangeable insert that is not in use is more likely to contact the body before contacting the extension. In examples of the present invention, the extension distance is less than 0.3, 0.2, 0.1, or 0.05 times less than the largest dimension of the body of an interchangeable insert.

In certain examples, the extension distance may also be proportional to the surface cross-section of the extension. By "surface cross-section" is meant a cross-section of an extension at the surface of the body of an interchangeable jewelry insert, the cross-section being parallel and coincident with any curve or surface of the body. When an interchangeable insert is coupled to a sleeve and an elastic extension extends from the sleeve, then the surface cross-section is determined at a curve or surface of the sleeve. Typically, an extension distance of greater than 4 times the largest dimension of the surface cross-section is not preferred as this results in an overly bendable extension that is susceptible to breaking down with repeated attachment and detachment of an interchangeable insert. An extension distance of less than 2 times the largest dimension of the surface cross-section is more suitable for repeated attachment and detachment of an interchangeable insert. In certain examples, extension distance of an extension of an interchangeable insert is less than 2, 1.5, 1, 0.5, or 0.3 times a surface cross-section for the extension.

In one example of the present invention, an O-ring is placed within a symmetrical groove that encircles the shaft of a cylindrical body of an interchangeable insert with approximately the inner half of the O-ring within the groove and the outer half of the O-ring extending from the surface of the body with an extension distance of approximately 1 mm. In this example, the diameter of the shaft without the groove is approximately 10 mm and the diameter of the shaft at the groove is approximately 9 mm, while the thickness of the O-ring is approximately 2 mm and the O-ring has an inner diameter of slightly less than 9 mm; the height of the cylindrical body is approximately 5 mm; the largest dimension of the surface cross-section is equivalent to the circumference of the shaft, approximately 31.4 mm and the extension distance is equivalent to the outer half of the O-ring, approximately 1 mm; accordingly in this example the extension distance is about 0.1 times the largest dimension of the body and is less than 0.032 times the largest dimension of the surface cross-section.

In order to achieve a secure fit within a receptacle of a jewelry item, an extension will preferably extend outward from two or more points on the periphery of the body of an interchangeable insert, with the two or more points having an angular separation of at least 30 degrees. By "angular separation" is meant the internal angle formed by lines joining the centroid or center of gravity of a body of an interchangeable insert with two points on the periphery of the body of the insert. As the internal angle is used to determine angular separation, angular separation may range from 0 degrees to 180 degrees.

Thus, in order to achieve a secure fit the two or more points of extension from the periphery of the body should not be too close together and typically should have an angular separation of at least 30 degrees. For example, an extension from points on the periphery having an angular separation of at least 40, 50, 60, 70, 80, 90 degrees or any angle therebetween can achieve a secure fit. Between the two points that are used for determining angular separation the extension may be continuous, for example a band, or separate, for example a series of studs, or any combination thereof.

In many examples of the present invention, the extension may include two points having an angular separation of less than 30 degrees, however in each of these examples at least one angular separation will typically be greater than 30 degrees. For example, where the extension extends from a continuum of points, such as would be the case for a band or rib-like extension, the band or the rib may be long enough such that the end points can have an angular separation of at least 30 degrees. Alternatively, two rib extensions, where neither rib has end points far enough apart to have an angular separation of greater than 30 degrees, could be placed far enough apart to have an angular separation of greater than 30 degrees between the points of extensions of the two ribs. In examples where there are two or more stud or spike-like extensions, some angular separations may be less than 30 degrees, but at least two studs or spikes typically extend from points on the periphery of the body having an angular separation of greater than 30 degrees. In certain examples a single rib extension may be used with a single stud extension where the stud extension has an angular separation of greater than 30 degrees from many of the points of the rib extension, but all of the points within the rib extension have an angular separation of less than 30 degrees relative to each other. In one example, an O-ring extension is coupled to a groove in a shaft of a cylindrical body. The O-ring extends from a continuum of points some of which have an angular separation of less than 30 degrees, but the O-ring has at least one angular separation that is greater than 30 degrees, and further the largest angular separation found at opposing points of the O-ring will typically be greater than 90 degrees; if the O-ring is placed in the same radial plane as the centroid of the cylindrical body, then within the continuum of points of extension the largest angular separation provide by opposing points would be 180 degrees. In another example, two perpendicular channels are bored through the shaft of a cylindrical body; each channel passes through the centroid that lies on the central axis of the body with both channels being in the same radial plane so as to intersect at the central axis. The two perpendicular channels create four openings at the surface of the body that can have elastically deformable extensions extending therefrom. In this example, there are two distinct sets of angular separation from the perspective of any one of the extensions, with the smallest angular separation being about 90 degrees and the largest angular separation being about 180 degrees.

External force must be applied to attach or detach the insert with respect to a receptacle. Typically, a jewelry wearer will push the insert into the receptacle such that an elastically deformable extension of the insert engages a surface of the receptacle. Any surface of the receptacle may be engaged provided that a secure fit is achieved. Once attached an insert remains secure until sufficient force is exerted on the insert, either by pushing or pulling, to cause elastic extensions of the insert to be sufficiently deformed to be released from frictional engagement with a surface of the receptacle. Accordingly, examples of the present invention demonstrate a simplified and convenient system for attaching or detaching an interchangeable insert within a jewelry item receptacle.

The present invention is further illustrated using examples that are depicted in the figures.

FIGS. 1A and 1B show top views of a ring (2) having an empty receptacle (4) and FIGS. 1C and 1D show side views of the ring (2) having an interchangeable insert (6) attached within the receptacle (4). The interchangeable insert is a cylindrical body with the shaft (8) of the body being coupled to an elastically deformable O-ring (10). The receptacle (4) has a base (16) and sidewall (18) defining an interior cylinder that is sized to receive the interchangeable insert (6). In a plane that is substantially parallel to the base (16) of the receptacle, the sidewall (18) has an inward extension (12) extending towards a central axis of the receptacle. The inward extension (12) of the receptacle is sized for deforming the elastically deformable O-ring (10) of the interchangeable jewelry insert and frictionally engaging the elastically deformable O-ring (10) on a surface of the inward extension (12) that is closest to the base (16) of the receptacle. To attach the interchangeable insert (6) within the receptacle (4), the insert is pushed down into the receptacle with sufficient manual force to cause the O-ring to be deformed by and pass by the inward extension (12) with the O-ring at least partially regaining its form in a groove (14) in a radial plane of the receptacle in between the base (16) and inward extension (12). To remove the insert (6) a finger or any other rod-like instrument, such as a pen, is inserted through an opening (20) in the base (16) of the receptacle and used to exert a sufficient external manual force on the base of the insert so as to overcome the frictional engagement of the O-ring with the surface of the inward extension (12) that is closest to the base (16) of the receptacle. The force is sufficient for the O-ring to be deformed by and pass by the inward extension, providing for release of the insert from the receptacle.

Figures 2A, 2B:
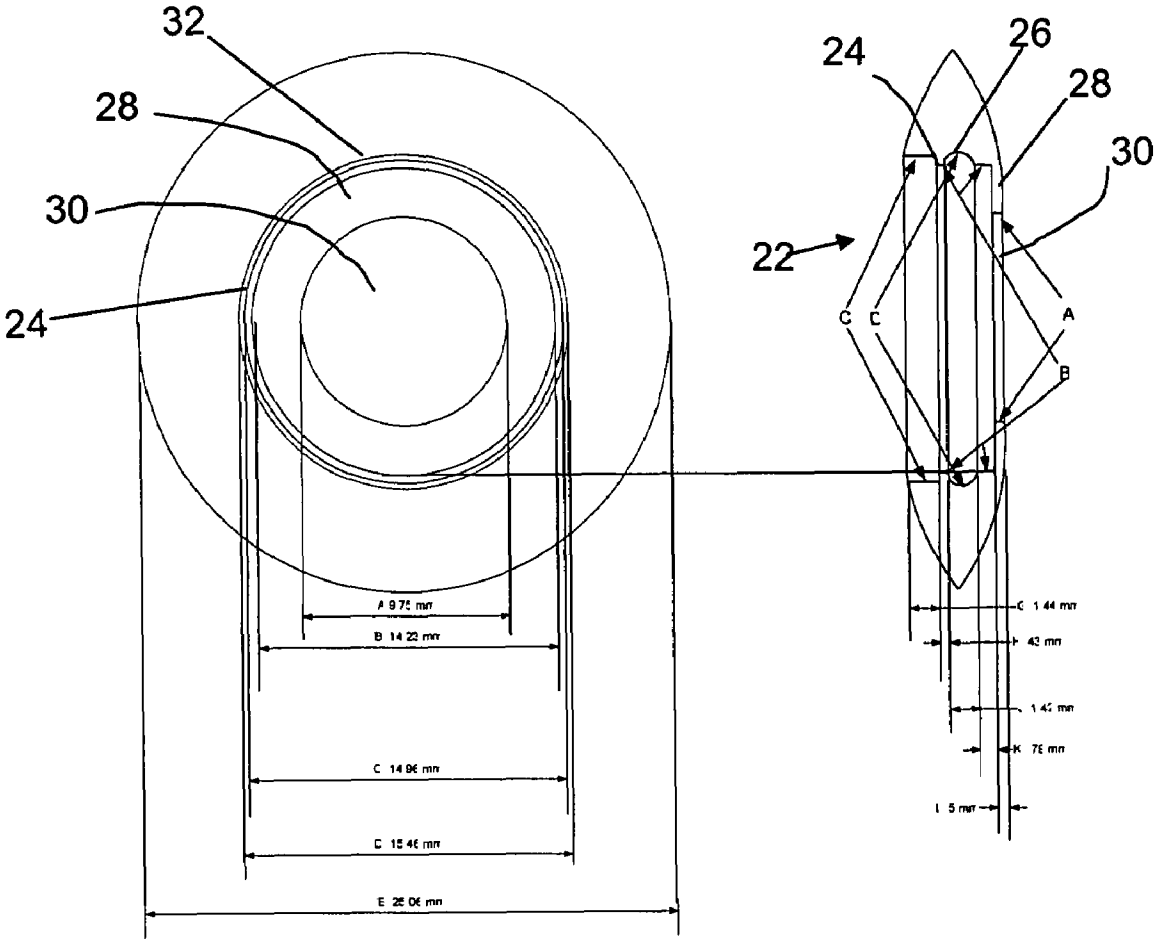
FIG. 2A shows a top cross-section view and FIG. 2B shows a side cross-section view of an empty receptacle of a pendant in accordance with a further embodiment of the present invention.

FIG. 2A provides a top view and FIG. 2B provides a side cross-section views of the receptacle of a pendant. The pendant receptacle (22) has a base (28) and sidewall (32) defining an interior cylinder that is sized to receive the interchangeable insert (34) shown in FIG. 3A. In a plane that is substantially parallel to the base (28) of the receptacle, the sidewall (32) has an inward extension (24) extending towards a central axis of the receptacle. The inward extension (24) of the receptacle is sized for deforming the elastically deformable O-ring (36) of the interchangeable jewelry insert and frictionally engaging the elastically deformable O-ring (36) on a surface of the inward extension (24) that is closest to the base (28) of the receptacle. To attach the interchangeable insert (34) within the receptacle (22), the insert is pushed down into the receptacle with sufficient manual force to cause the O-ring to be deformed by and pass by the inward extension (24) with the O-ring at least partially regaining its form in a groove (26) in a radial plane of the receptacle in between the base (28) and inward extension (24). To remove the insert (34) a finger, or any other rod-like instrument, such as a pin or a pencil, is inserted through an opening (30) in the base (28) of the receptacle and used to exert a sufficient external manual force on the base of the insert so as to overcome the frictional engagement of the O-ring with the surface of the inward extension (24) that is closest to the base (28) of the receptacle. The dimensions of the features of the base (28) and sidewall (32) are labeled as follows: A, 9.75 mm; B, 14.23 mm; C, 14.96 mm; D, 15.46 mm; E, 25.06 mm; G, 1.44 mm; H, 0.43 mm; J, 1.42 mm; K, 0.79; and L 0.5 mm.

Figures 3A, 3B, 3C, 3D, 3E:
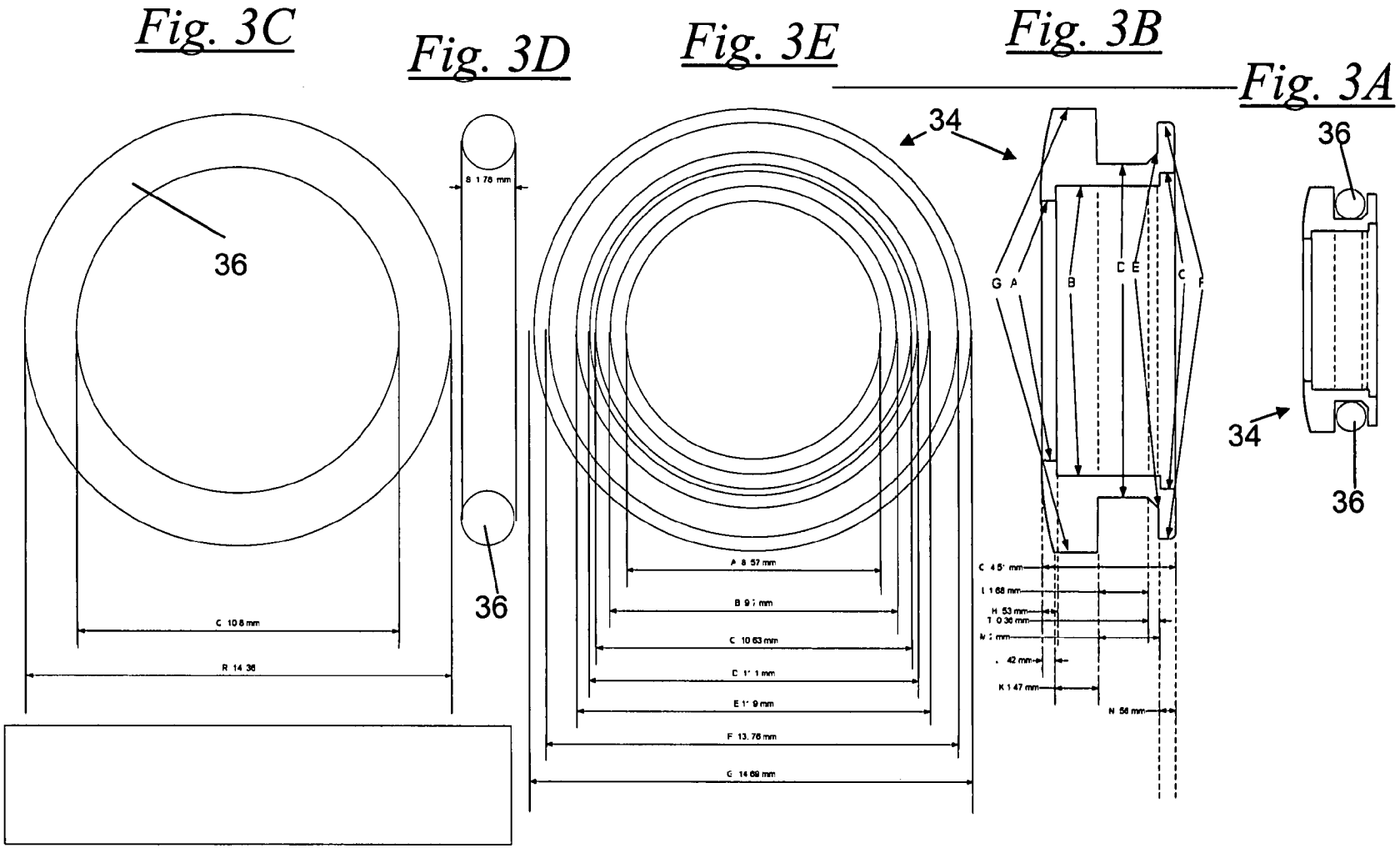
FIGS. 3A and 3B show side cross-section views of an interchangeable insert.
FIGS. 3C and 3D show cross-section views of an O-ring.
FIG. 3E shows a top cross-section view of an interchangeable insert in accordance with a further embodiment of the present invention.
Figure 4A:
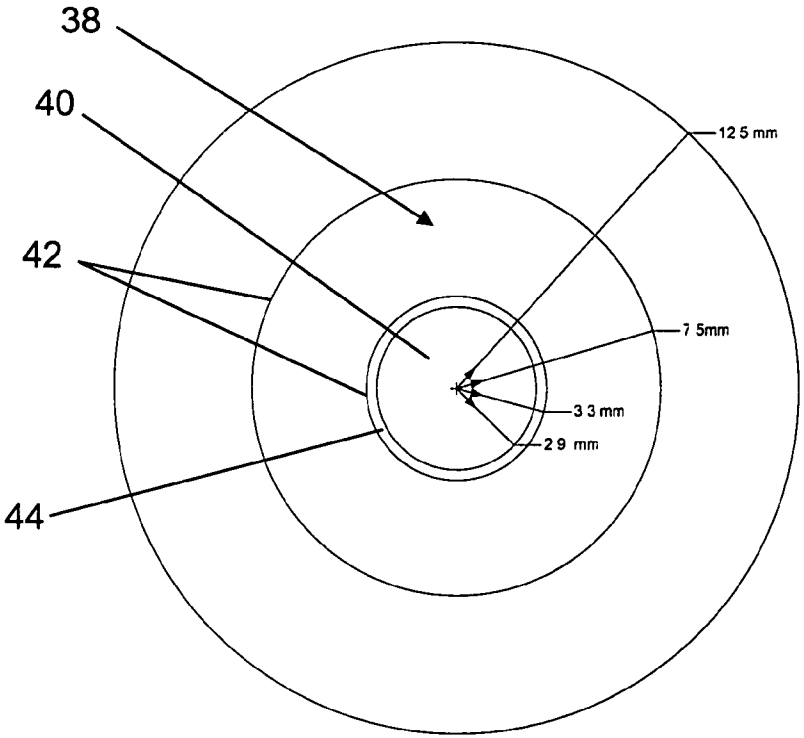
FIGS. 4A and 4B show top and side cross-section views of a pendant having an empty receptacle in accordance with a further embodiment of the present invention.
Figure 4B:
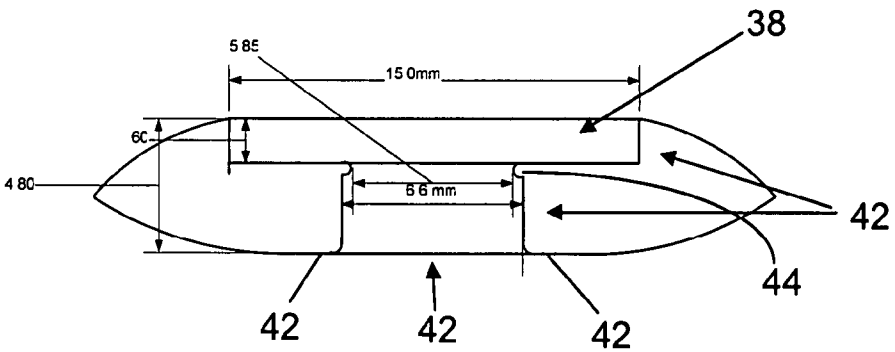
Figures 5A, 5B, 5C, 5D:
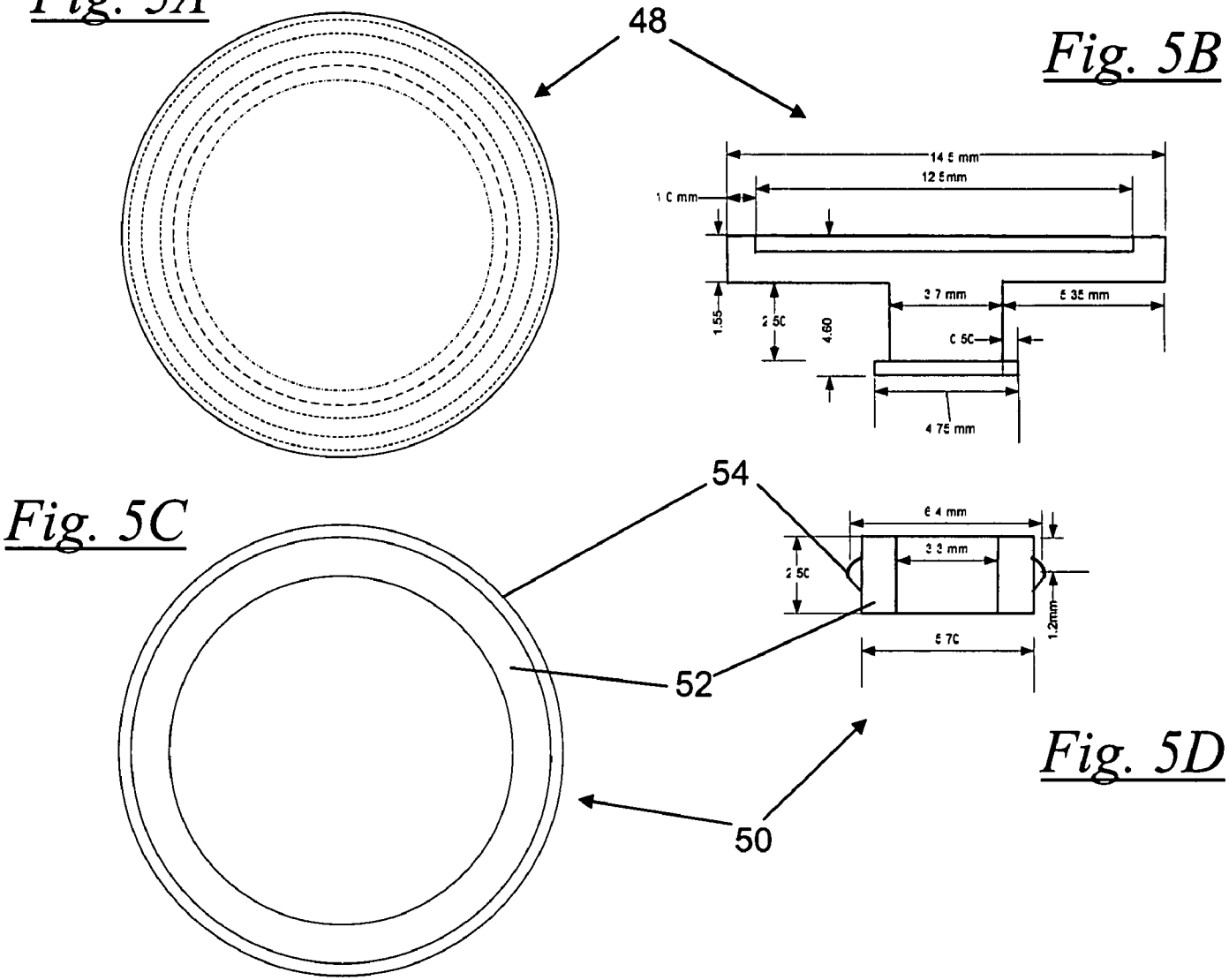
FIGS. 5A-D show top and side cross-section views of an interchangeable insert (48) and rubber sleeve (50) comprising a rubber extension (52) in accordance with a further embodiment of the present invention.

FIGS. 3A and 3B show side cross-section views of an interchangeable insert that can be detachably attached to the pendant shown in FIGS. 2A and 2B. The interchangeable insert is shown in the presence (FIG. 3A) or absence (FIG. 3B) of the O-ring (36). FIGS. 3C and 3D show top and side cross-section views of the O-ring (36). FIG. 3E is a top cross-section view of the interchangeable insert. The dimensions of features of the insert are labeled as follows: A, 8.57 mm; B, 9.7 mm; C, 10.63 mm; D, 11.1 mm; E, 11.9 mm; F, 13.76 mm; G, 14.69 mm; H, 0.53 mm; J, 0.42 mm; K, 1.47 mm; L, 1.68 mm; M, 2 mm; N, 0.56 mm; O, 4.51 mm; Q, 10.8 mm; R, 14.36 mm; and S, 1.78 mm.

Figure 6:
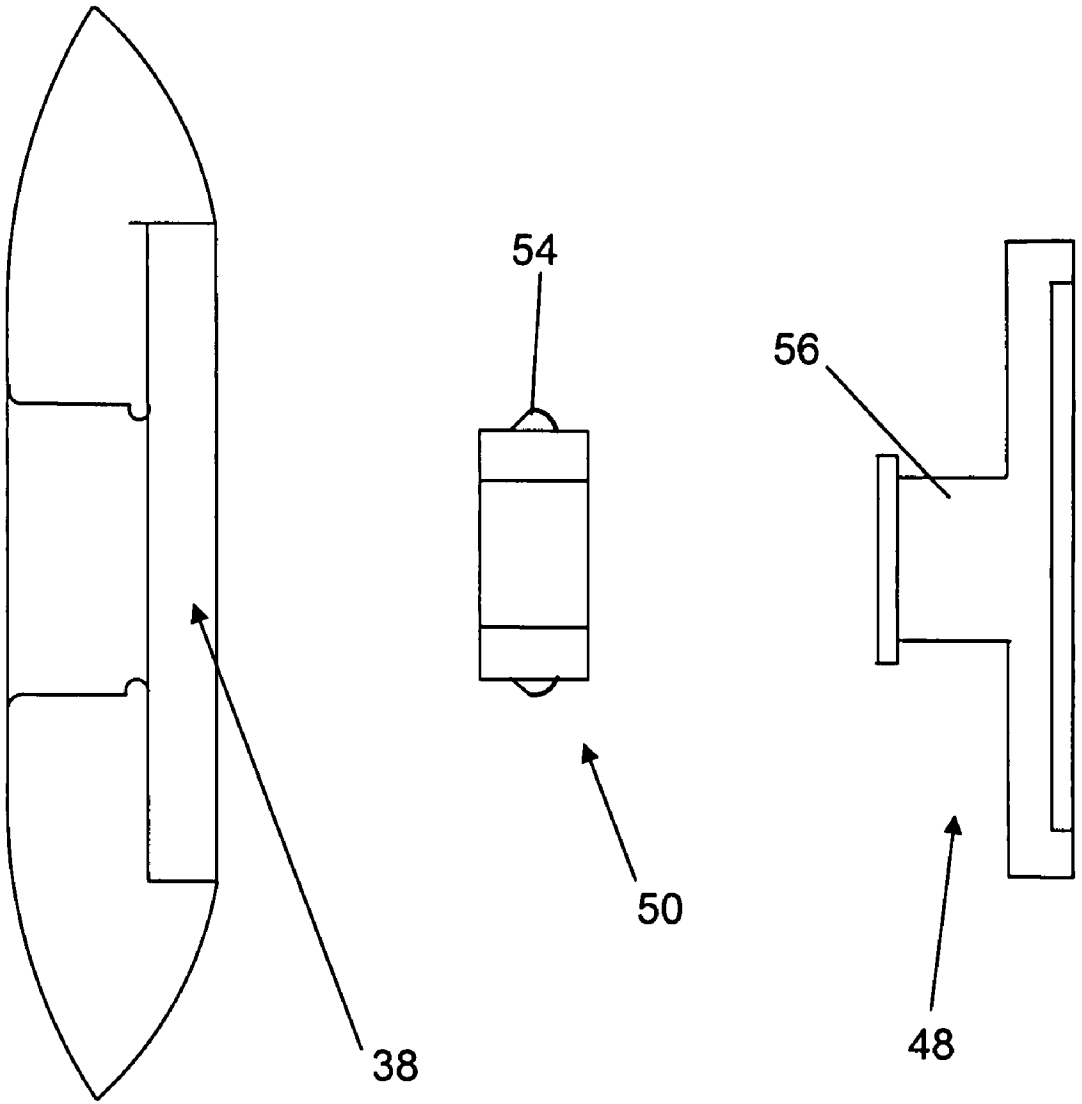
FIG. 6 shows an exploded side cross-section view of the pendant shown in FIG. 4, and rubber sleeve (50) and interchangeable insert (48) shown in FIG. 5 in accordance with a further embodiment of the present invention.
Figure 7:
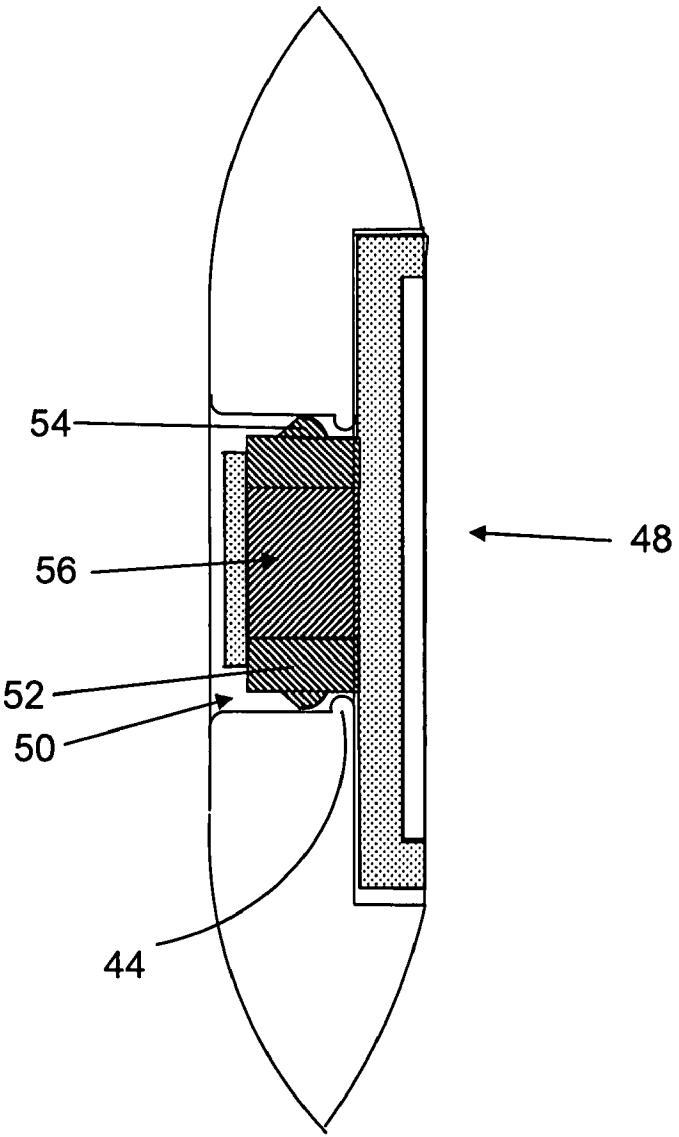
FIG. 7 shows an assembled view of the pendant shown in FIGS. 4 and 6 having the interchangeable insert (48) attached within the receptacle (38) in accordance with a further embodiment of the present invention.

FIGS. 4-7 show another example of a pendant with an interchangeable insert. FIGS. 4A and 4B show top and side cross-section views of a pendant having an empty receptacle (38), FIGS. 5A-D show top and side cross-section views of an interchangeable insert (48) and rubber sleeve (50) comprising a rubber extension (52), FIG. 6 shows a exploded side cross-section view of the pendant, rubber sleeve (50), and interchangeable insert (48), and FIG. 7 shows an assembled view of the pendant having the interchangeable insert (48) attached within the receptacle (38). The interchangeable insert is a cylindrical body with the shaft (56) of the body being coupled to a rubber sleeve (50) comprising a sleeve portion (52) and an elastically deformable rubber extension (54) extending from the sleeve portion. The receptacle (38) has a base (46) and sidewall (42) defining an interior cylinder that is sized to receive the interchangeable insert (48). In a plane that is substantially parallel to the base (46) of the receptacle, the sidewall (42) has an inward extension (44) extending towards a central axis of the receptacle. The inward extension (44) of the receptacle is sized for deforming the elastically deformable extension (54) of the interchangeable jewelry insert the elastically deformable extension (54) at least partially regaining its form after passing by the inward extension and frictionally engaging a surface of the sidewall (42) that is in between the inward extension (44) and the base (46) of the receptacle. To attach the interchangeable insert (48) within the receptacle (38), the insert is pushed down into the receptacle with sufficient manual force to cause the elastic extension (54) to be deformed by and pass by the inward extension (44) with the elastic extension (54) at least partially regaining its form in frictionally engaging a surface of the sidewall (42) that is in between the inward extension (44) and the base (46) of the receptacle. In the attached position the elastic extension (54) does not engage a surface of the inward extension (44). To remove the insert (48) a finger or any other rod-like instrument, is inserted through an opening (40) in the base (46) of the receptacle and used to exert a sufficient external manual force on the base of the insert so as to overcome the frictional engagement of the elastic extension (54) with the surface of the sidewall (42) and the surface of the inward extension (44). The force is sufficient for the elastic extension (54) to be deformed by and pass by the inward extension, providing for release of the insert from the receptacle.

Figures 8A, 8B:
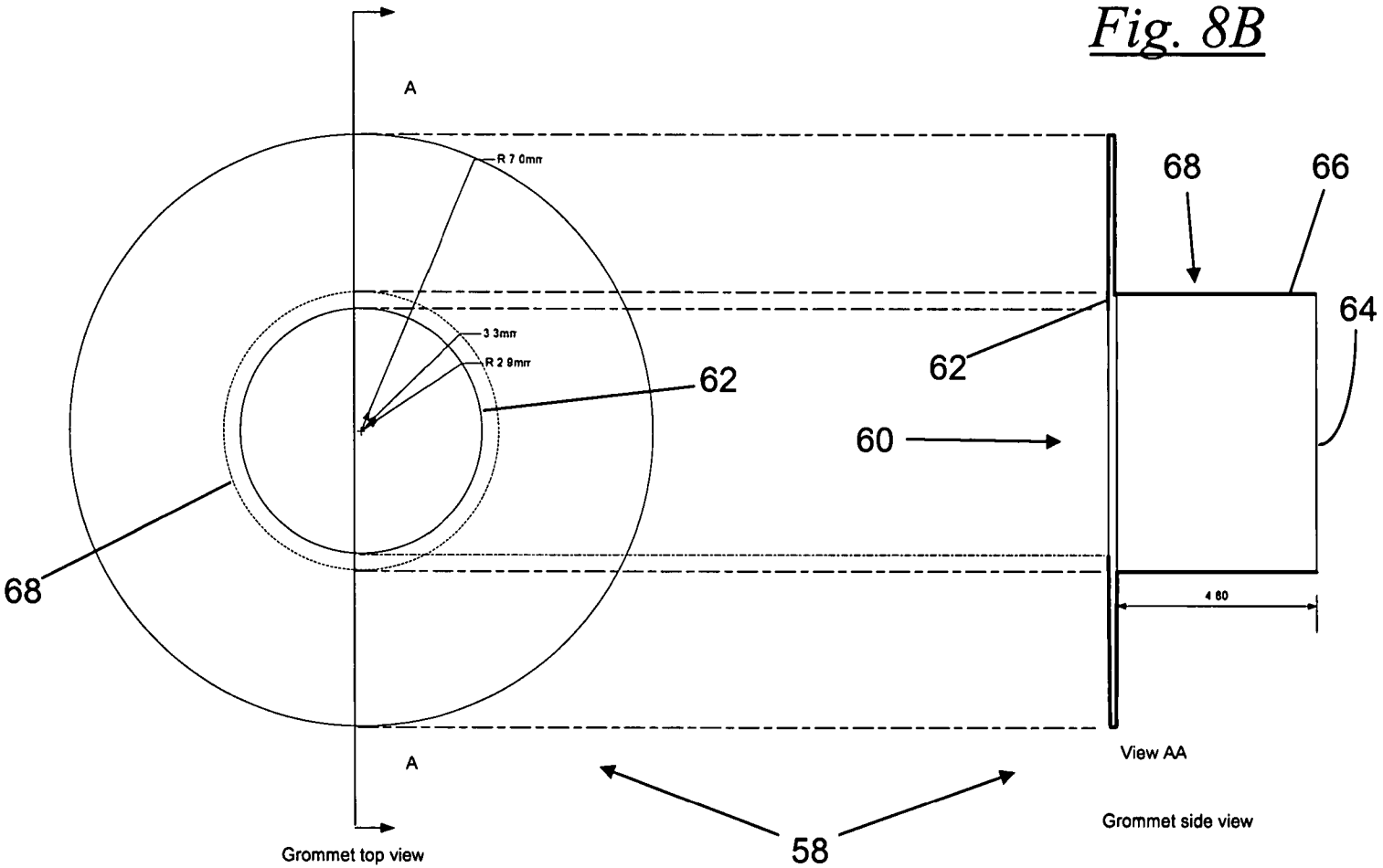
FIGS. 8A and 8B show top and side cross-section views of a grommet having an empty receptacle (60) in accordance with a further embodiment of the present invention.
Figure 9:
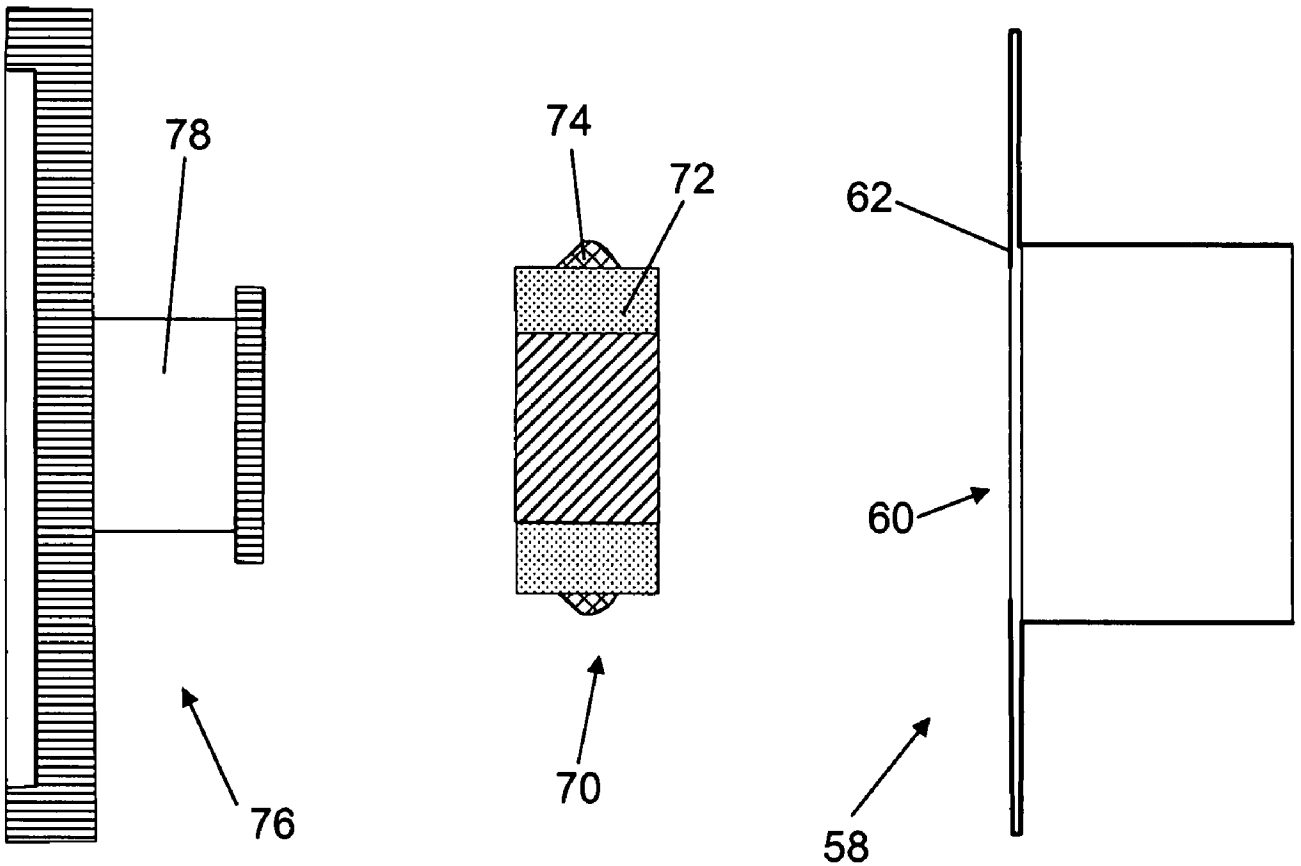
FIG. 9 shows an exploded side cross-section view of the grommet (58), rubber sleeve (70), and interchangeable insert (76) in accordance with a further embodiment of the present invention.
Figure 10:
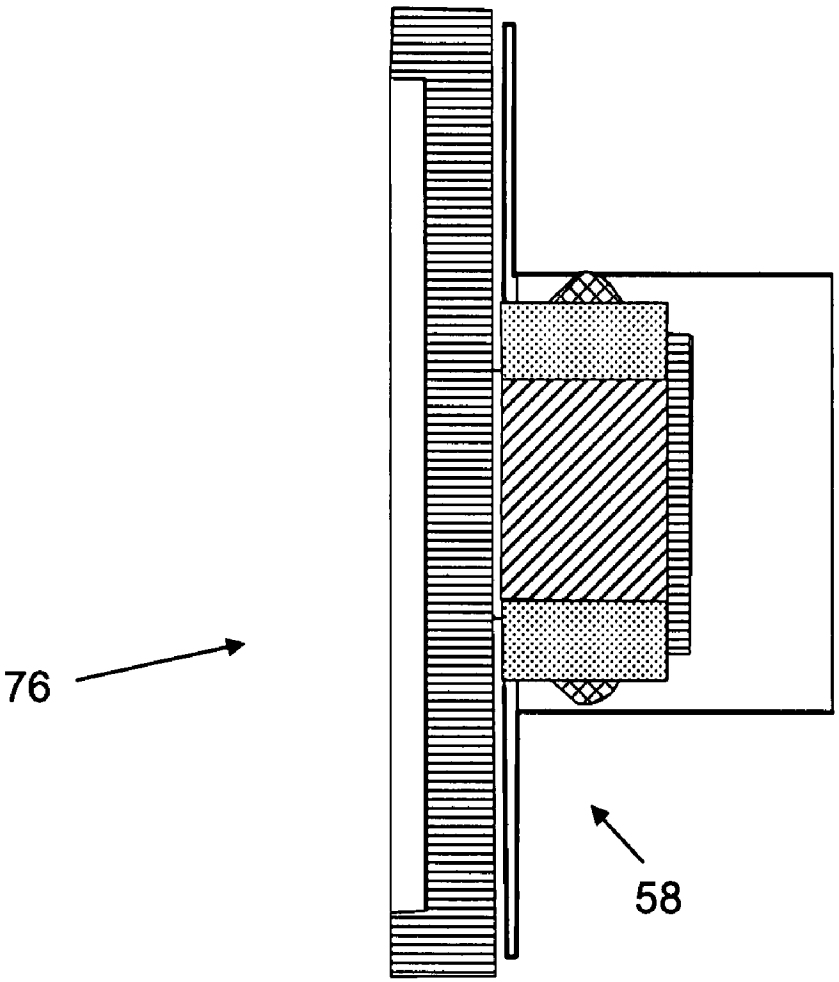
FIG. 10 shows an assembled view of the grommet shown in FIGS. 8-9 having the interchangeable insert (76) attached within the receptacle (60) in accordance with a further embodiment of the present invention.

FIGS. 8-10 show an interchangeable insert that will fit a grommet that will be found in clothing and other articles including, without limitation, jeans, jean jackets and shirts etc., belts, handbags, leather wristbands, hats and even pet jewelry. The grommet comprises a base end (64) and a sidewall (68) that defines an interior cylinder sized to fit at least a portion of an interchangeable insert. The portion of the sidewall furthest from the base comprises a lid flange (80) that extends radially outward with the lid flange (80) being folded back on itself and extending towards a central axis of the cylinder to form an inward extension (62). In another example of a grommet (not shown), the grommet comprises a sidewall that defines an interior cylinder having two open ends, a lid end and a base end. At the lid end the sidewall extends towards a central axis to form an inward extension and then folds back to extend radially outward to form a lid flange. To incorporate the grommet into an article a the portion of the sidewall closest (66) to the base end (64) is folded radially outward to form a base flange that engages a retaining washer (not shown) with the grommet being held within the article by opposing forces of the retaining washer and lid flange (80). FIGS. 8A and 8B show top and side cross-section views of a grommet having an empty receptacle (60), FIG. 9 shows an exploded side cross-section view of the grommet (58), rubber sleeve (70), and interchangeable insert (76), and FIG. 10 shows an assembled view of the grommet having the interchangeable insert (76) attached within the receptacle (60). The interchangeable insert is a cylindrical body with the shaft (78) of the body being coupled to a rubber sleeve (70) comprising a sleeve portion (72) and an elastic extension (74) that is continuous with and extending outward from the sleeve portion. The grommet receptacle (60) has a base (64) and sidewall (68) defining an interior cylinder that is sized to receive at least a portion of the interchangeable insert (76). The sidewall (68) has an inward extension (62) extending towards a central axis of the receptacle. The inward extension (62) of the receptacle is sized for deforming the elastic extension (74) of the interchangeable jewelry insert with the elastic extension (74) at least partially regaining its form after passing by the inward extension and frictionally engaging a surface of the sidewall (68) that is in between the inward extension (62) and the base (64) of the receptacle. To attach the interchangeable insert (76) within the grommet receptacle (60), the insert is pushed down into the receptacle with sufficient manual force to cause the elastic extension (74) to be deformed by and pass by the inward extension (62) with the elastic extension (54) at least partially regaining its form in frictionally engaging a surface of the sidewall (68) that is in between the inward extension (62) and the base (64) of the receptacle. In the attached position the elastic extension (74) does not engage a surface of the inward extension (62). To remove the insert (76) a rod-like instrument is pushed through the open base end or the portion of the insert that is outside the receptacle is pulled or pried with sufficient external manual force so as to overcome the frictional engagement of the elastic extension (74) with the surface of the sidewall (68) and the surface of the inward extension (62). The force is sufficient for the elastic extension (62) to be deformed by and pass by the inward extension, providing for release of the insert from the grommet receptacle.

Figure 11C:
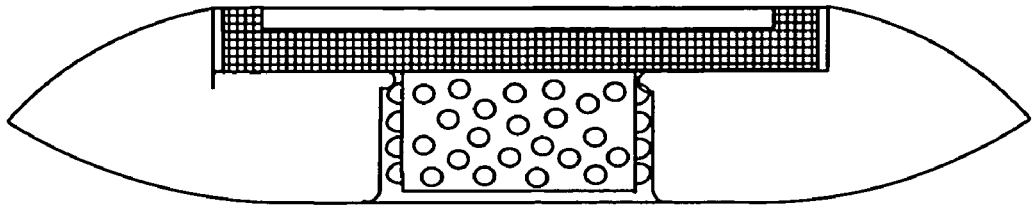
FIG. 11A shows a side view of another example of an interchangeable insert and FIGS. 11B and 11C show exploded and assembled views of a pendant and insert combination in accordance with a further embodiment of the present invention.
Figure 11B:
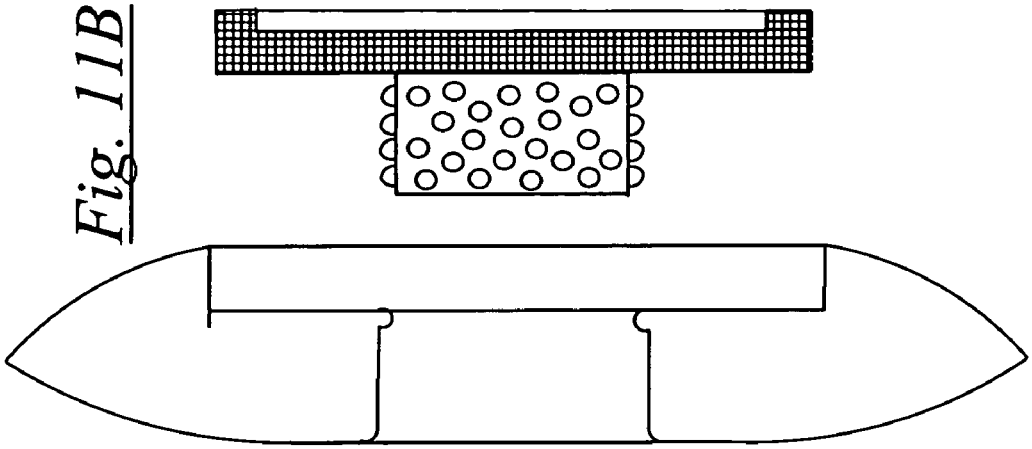
Figure 11A:
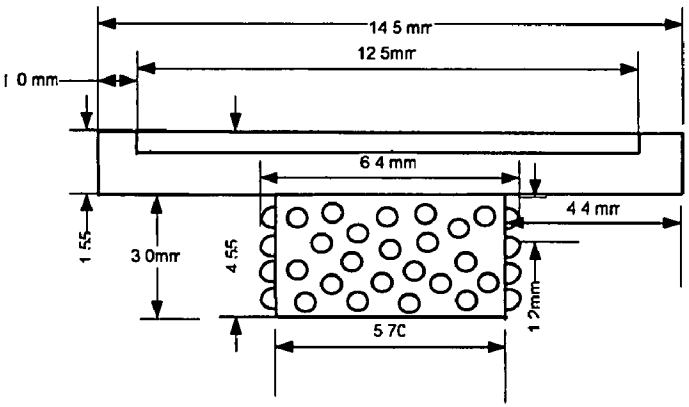
Figure 12A:
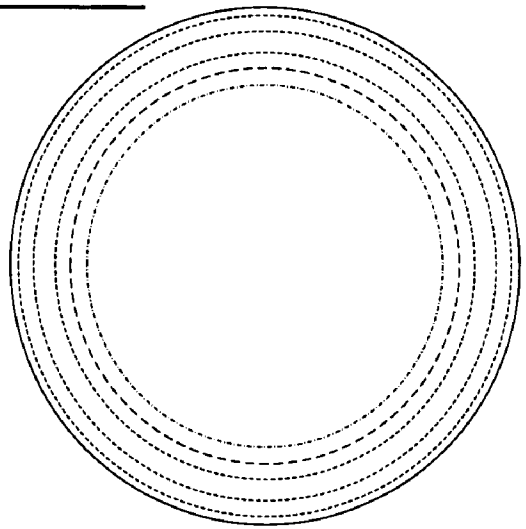
Figure 12B:
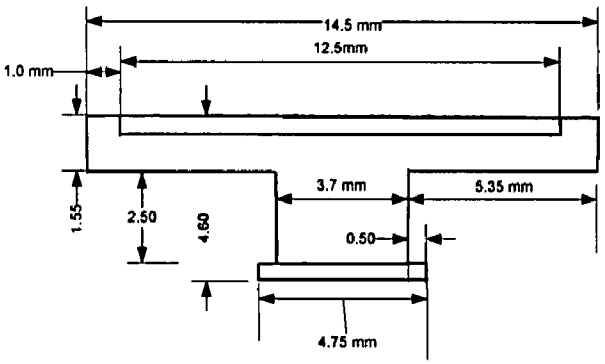
Figure 12C:
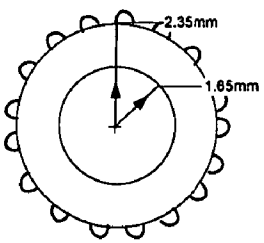
Figure 12D:
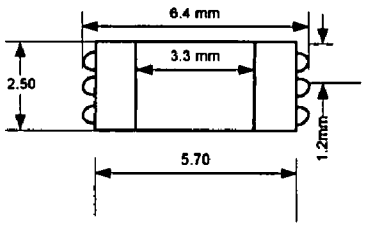
Figure 12E:
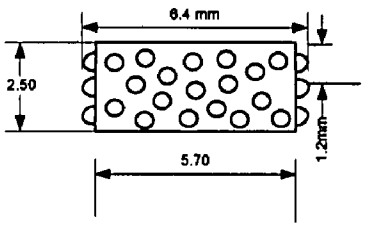
Figure 13D:
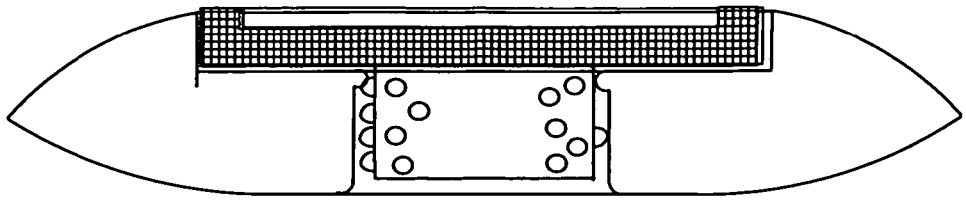
FIGS. 13A-D show yet another example of the invention with FIG. 13A showing a side view and FIG. 13B showing a bottom view of an interchangeable insert and FIGS. 13C and 13D showing exploded and assembled views of this pendant and insert combination in accordance with a further embodiment of the present invention.
Figure 13C:
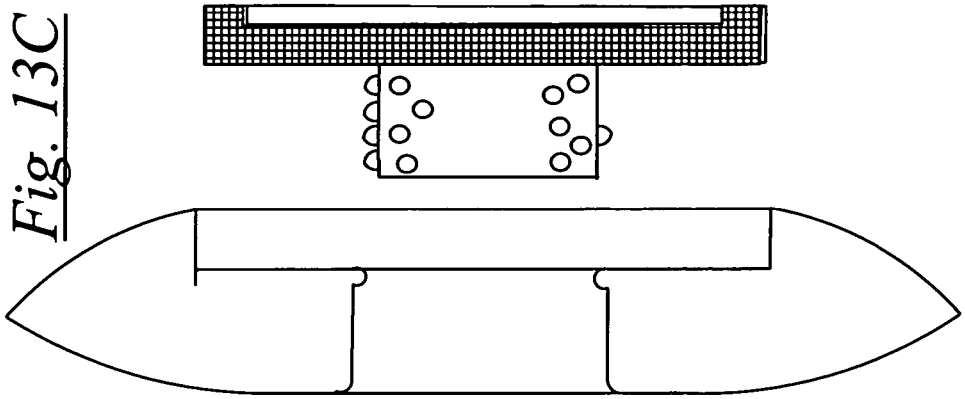
Figure 13A:
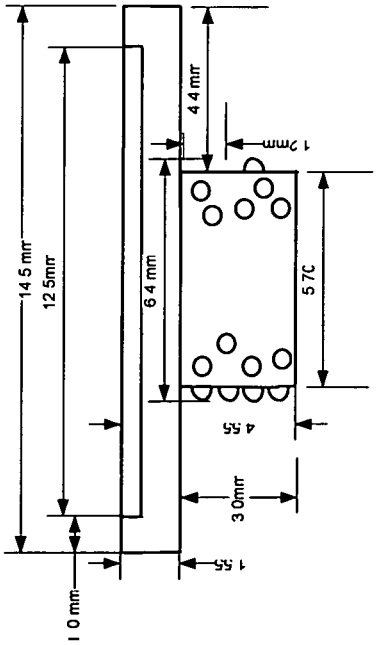
Figure 13B:
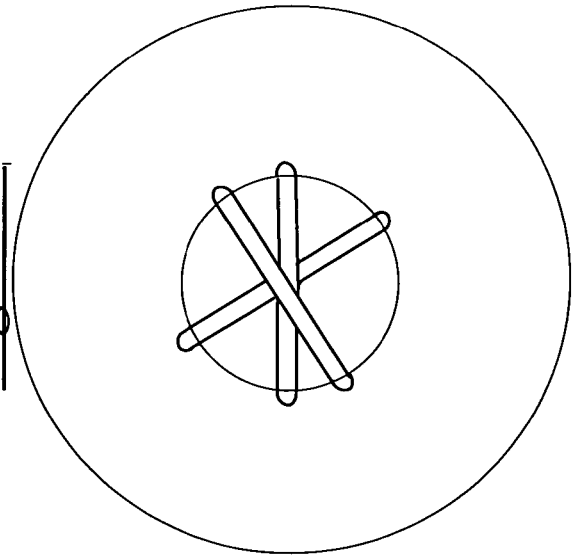

FIGS. 11-13 show other examples of pendants with interchangeable inserts. FIG. 11A shows a side view of an insert having rubber extruded from a hollow metal shaft of the body to form several spike-like elastic extensions. The rubber is extruded through holes that are bore through the shaft surface. FIGS. 11B and 11C show exploded and assembled views of the pendant and insert combination. FIGS. 12A-G show another example of the invention, with FIGS. 12A and 12B showing top and side views of a body of an interchangeable insert that has a shaft that can receive a rubber sleeve. FIGS. 12C, 12D, and 12E show a top view, side cross-section view, and side view of the rubber sleeve comprising several separate stud-like extensions, with FIGS. 12F and 12G showing exploded and assembled views of the pendant and insert combination. FIGS. 13A-D show yet another example of the invention with FIG. 13A showing a side view and FIG. 13B showing a bottom view of an interchangeable insert having holes bored through the shaft of the body and having rubber rods inserted through the holes and extending therefrom. FIGS. 13C and 13D show exploded and assembled views of this pendant and insert combination.

Figure 14B:
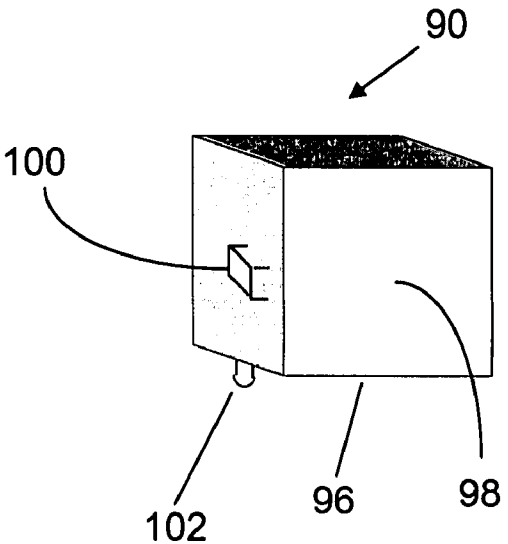
FIG. 14A shows a side perspective views of a ring (92) having an empty receptacle (94) and FIG. 14B shows an interchangeable insert (90) that may be detachably attached within the receptacle (94) in accordance with a further embodiment of the present invention.
Figure 14A:
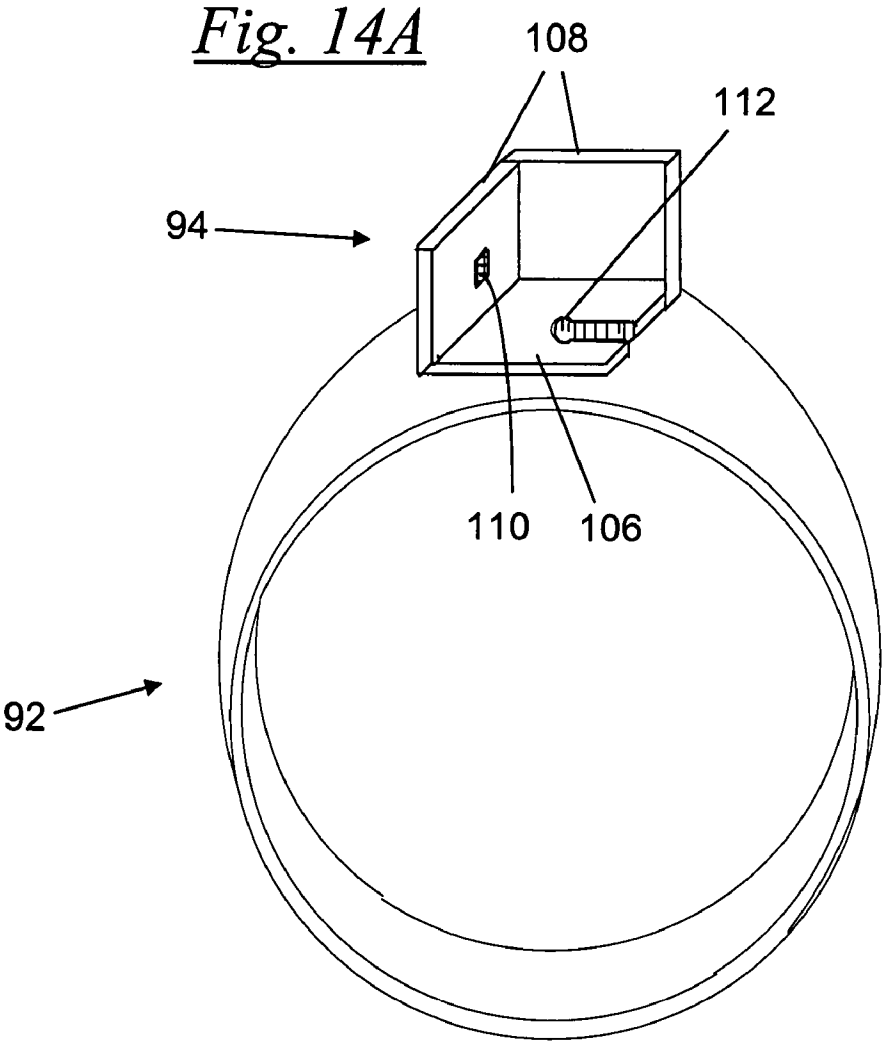

Still another example of the present invention is shown in FIGS. 14A-B. FIG. 14A shows a side perspective views of a ring (92) having an empty receptacle (94) and FIG. 14B shows an interchangeable insert (90) that may be detachably attached within the receptacle (94). The interchangeable insert (90) is a cubic body with the shaft (98) of the body having a cube shaped elastic extension (100) extending therefrom and the base (96) of the body having a spike-like elastic extension (102) extending therefrom. The receptacle (94) has a base (106) and sidewall (108) that is sized to receive the interchangeable insert (90). The base (106) of the receptacle and the sidewall (108) have a groove or cavity (110, 112) for receiving and frictionally engaging the elastic extensions (100, 102) of the insert. The cavity openings are smaller than the extensions while the cavity interiors are larger than the cavity openings. Thus the cavity opening is a lip that frictionally engages the extensions. To attach the interchangeable insert (90) within the receptacle (94), the insert is slid or pushed into the receptacle with sufficient manual force to cause the extensions to be deformed by and pass by the cavity openings with the extensions at least partially regaining form within the interior of the cavities. To remove the insert (90), the body is pulled or pried with sufficient external manual force so as to overcome the frictional engagement of the extensions (100, 102) with the opening of the cavities (110, 112) of the receptacle.

Figure 15B:
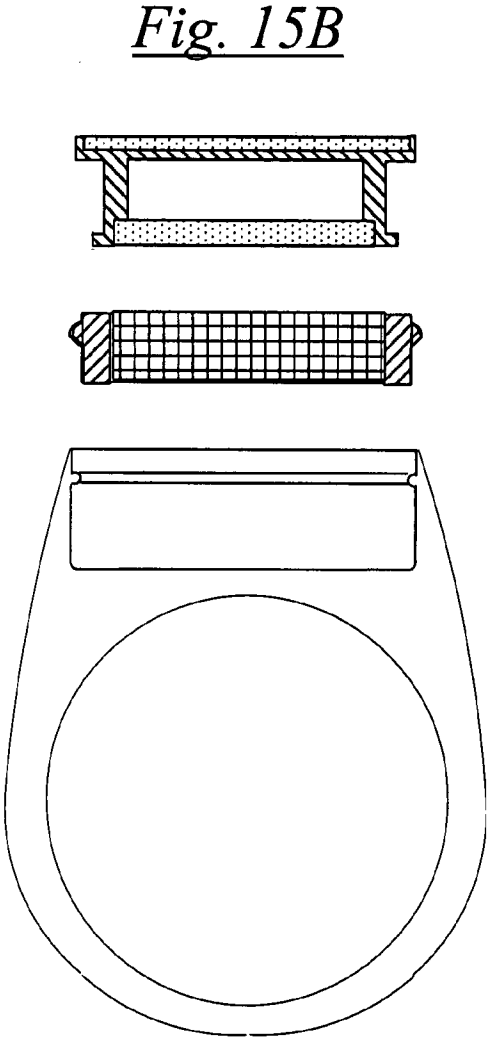
FIG. 15B shows an exploded side cross-section view of an interchangeable insert body, a rubber sleeve comprising a rubber extension and the ring shown in FIG. 15A.
Figure 15A:
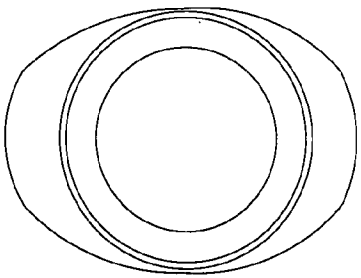
FIG. 15A shows a top view of another example of a ring having an empty receptacle.
Figure 15C:
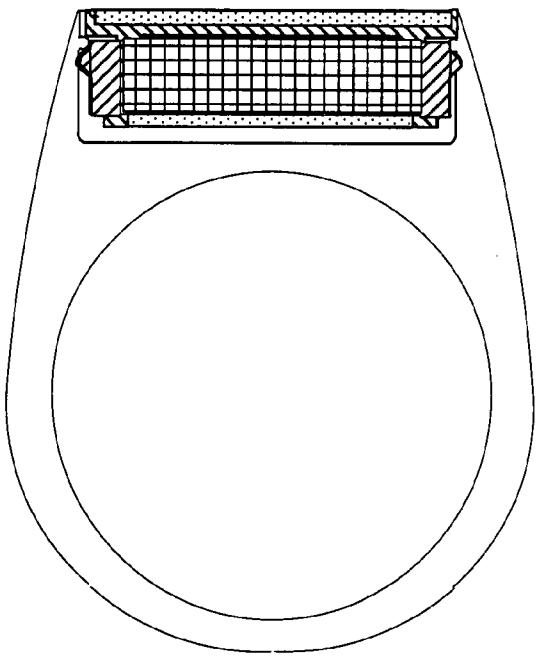
FIG. 15C shows an assembled view of the interchangeable insert and ring combination in accordance with a further embodiment of the present invention.

FIG. 15A-C show another example of a ring. FIG. 15A shows a top view of a ring having an empty receptacle, while FIG. 15B shows an exploded view and FIG. 15C shows an assembled view of the ring and insert combination.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. An interchangeable jewellery insert for detachable attachment to a receptacle of an item, the insert comprising:

a body having a first end and a second end, the first end having at least one dimension sized to fit within a receiving aperture of the receptacle of the item, the second end having at least one dimension larger than an inward extension of the receiving aperture; and an extension formed of elastic material and coupled to the body, the extension being a closed continuous circuit along a periphery of the body, the extension extending outward and being deformed by the inward extension of the receptacle, and frictionally engaging a surface of the receiving aperture.

2. The interchangeable jewellery insert of claim 1, wherein the body is cylindrical and the closed continuous circuit is an O-ring, with the 0-ring extending in a radial plane from the periphery of the body.

3. The interchangeable jewellery insert of claim 1, wherein the body is cylindrical, comprising a top, a base and a shaft, the shaft being coupled with the extension and the extension extends outward in a radial plane.

4. An item having a receptacle for detachably attaching the interchangeable jewellery insert of claim 1.

5. The item of claim 4, wherein the item is selected from the group consisting of ring, earring, pendant, bracelet, necklace, pin, brooch, button, grommet, key chain, pen, zipper pull, handbag, backpack, belt, shoe, clothing, watch strap, pet jewellery, sunglasses, and body piercing jewellery.

6. The item of claim 4, wherein the receptacle comprises:

a base and a sidewall, the base sized to fit the second end of the body of the interchangeable jewellery insert, the sidewall defining the receiving aperture, having the inward extension extending towards a central axis of the receptacle, and a surface for frictionally engaging the extension; and the inward extension of the receptacle sized for deforming the extension.

7. The receptacle of claim 6, wherein the sidewall is continuous and the inward extension is continuous along the entire interior surface of the sidewall.

8. The receptacle of claim 6, wherein the base comprises an opening.

9. The receptacle of claim 6, wherein the jewellery item is selected from the group consisting of ring, earring, pendant, bracelet, necklace, pin, brooch, button, grommet, key chain, pen, zipper pull, handbag, backpack, belt, shoe, clothing, watch strap, pet jewellery, and body piercing jewellery.

10. The item of claim 4, wherein the inward extension is adjacent to the base of the receptacle.

11. The item of claim 4, wherein the inward extension is in a plane that is substantially parallel to the base.

12. The item of claim 4, wherein the jewellery item is selected from the group consisting of ring, pendant, button, and grommet.

13. The item of claim 4, wherein the jewellery item is a button or a grommet, and the sidewall is a continuous sidewall.

* * * * *